US011298709B2

(12) United States Patent
Li

(10) Patent No.: US 11,298,709 B2
(45) Date of Patent: Apr. 12, 2022

(54) LOW-PRESSURE SPRAY NOZZLE ASSEMBLY

(71) Applicant: QUA TECH LIMITED, Shanghai (CN)

(72) Inventor: Bijun Li, Shanghai (CN)

(73) Assignee: QUA TECH LIMITED, Shanghai (CN)

( * ) Notice: Subject to any disclaimer, the term of this patent is extended or adjusted under 35 U.S.C. 154(b) by 45 days.

(21) Appl. No.: 16/706,833

(22) Filed: Dec. 9, 2019

(65) Prior Publication Data

US 2020/0238310 A1 Jul. 30, 2020

(30) Foreign Application Priority Data

Jan. 30, 2019 (CN) ..... 201910090917.8

(51) Int. Cl.

| | |
|---|---|
| ***B05B 5/03*** | (2006.01) |
| ***B05B 5/16*** | (2006.01) |
| ***B05B 7/04*** | (2006.01) |
| ***B05B 3/08*** | (2006.01) |
| ***B05B 7/02*** | (2006.01) |
| ***B05B 1/04*** | (2006.01) |
| ***B05B 15/534*** | (2018.01) |

(Continued)

(52) U.S. Cl.

CPC ..... *B05B 3/087* (2013.01); *B05B 1/046* (2013.01); *B05B 7/025* (2013.01); *B05B 15/534* (2018.02); *B05B 1/341* (2013.01); *B05B 7/0012* (2013.01); *B05B 15/63* (2018.02)

(58) Field of Classification Search

CPC ..... B05B 7/025; B05B 3/087; B05B 1/046; B05B 1/341; B05B 15/534; B04C 2003/003

USPC ..... 239/214

See application file for complete search history.

(56) References Cited

U.S. PATENT DOCUMENTS 3,743,187 A * 7/1973 Breunsbach ..... E04F 21/12 239/489

3,746,262 A * 7/1973 Bete ..... B05B 1/12 239/458

(Continued)

FOREIGN PATENT DOCUMENTS

DE 102017002139 A1 * 9/2018 ..... C02F 1/005

OTHER PUBLICATIONS

Machine Translation of DE102017002139A1, May 19, 2021, Google Patents, 11 Pages (Year: 2021).*

*Primary Examiner* — Arthur O. Hall
*Assistant Examiner* — Kevin Edward Schwartz

(57) ABSTRACT

A low-pressure spraying equipment for atomizing a working fluid at a low-pressure, includes a spray tip body having a top and a lower end, a handle arranged on the top of the spray tip body, and a chamfer defined at the lower end of the spray tip body. The spray tip body further includes a retaining shoulder and a ring collar, a mounting hole having a channel axis, a pre-atomizing component, and a tip atomizing component. The pre-atomizing component further includes a feeding channel, a pre-atomization channel, and a pre-atomization regulating channel. The feeding channel, the pre-atomization channel, and the pre-atomization regulating channel are three coaxial hollow channels sequentially defined and connected along the channel axis inside the pre-atomizing component.

13 Claims, 6 Drawing Sheets

(51) Int. Cl.

| | |
|---|---|
| ***B05B 7/00*** | (2006.01) |
| ***B05B 1/34*** | (2006.01) |
| ***B05B 15/63*** | (2018.01) |

(56) References Cited

U.S. PATENT DOCUMENTS

| | | | | |
|---|---|---|---|---|
| 6,851,629 | B2 * | 2/2005 | Stier | F02M 51/0671 239/533.12 |
| 8,814,070 | B2 | 8/2014 | Drozd et al. | |
| 9,675,982 | B2 | 6/2017 | Becker et al. | |
| 2016/0303585 | A1 * | 10/2016 | Wenzel | B05B 1/048 |
| 2018/0178228 | A1 * | 6/2018 | Kinne | B05B 9/0861 |
| 2019/0336992 | A1 * | 11/2019 | Wang | B05B 3/02 |
| 2020/0030828 | A1 * | 1/2020 | Seeley | F23D 14/125 |
| 2020/0164390 | A1 * | 5/2020 | Tam | B05B 9/01 |

* cited by examiner

LOW-PRESSURE SPRAY NOZZLE ASSEMBLY

CROSS-REFERENCE TO RELATED APPLICATIONS

This application claims the benefit of Chinese Patent Applications 201910090917.8, filed Jan. 30, 2019. The entire disclosure of the application referenced above is incorporated by reference.

FIELD

The present disclosure generally relates to spraying equipment, and more particularly to low-pressure airless spraying equipment.

BACKGROUND

Hand-held fluid sprayers (e.g., hand-held electric spray guns, high-pressure airless sprayers, and general-purpose spray guns, etc.) are often used in household painting. Low-pressure hand-held electric spray guns are usually used to paint relatively small area. Because the fluid pressure is low at the inlet of the passage and the fluid pressure is even lower at the outlet of the passage due to the pressure loss, the sprayed pattern may have nonuniform diffusion.

Thus, a spray tip with an improved internal flow channel structure for a low-pressure fluid sprayer to produce a uniformity of the spray pattern is desired. As disclosed below, the spray tip with improved internal flow channel structure significantly improves upon the state-of-the-art, solves the above problems, and enables functions that could not have been effectively performed before.

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

A low-pressure spraying equipment includes a spray tip body having a top and a lower end, a handle arranged on the top of the spray tip body, and a chamfer defined at the lower end of the spray tip body. The handle further includes a spray direction indicator on a side of the handle. The spray direction indicator is designed to point to a discharge direction of the spray tip body. The spray tip body further includes a retaining shoulder and a ring collar, a mounting hole having a channel axis, a pre-atomizing component, and a tip atomizing component. The pre-atomizing component further includes a feeding channel, a pre-atomization channel, and a pre-atomization regulating channel. The feeding channel, the pre-atomization channel, and the pre-atomization regulating channel are three coaxial hollow channels sequentially defined and connected along the channel axis inside the pre-atomizing component. The feeding channel, the pre-atomization channel, and the pre-atomization regulating channel form a dumbbell-shaped hallow structure. The pre-atomizing component and the tip atomizing component are connected to each other sequentially along the channel axis, in a fluid stream direction.

Further areas of applicability of the present disclosure will become apparent from the detailed description, the claims, and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings.

In the drawings, reference numbers may be reused to identify similar and/or identical elements.

DETAILED DESCRIPTION

The present disclosure describes a low-pressure spray nozzle assembly that has the following enhanced outcomes: for example, produces a uniform spraying pattern and eliminates streaks of spraying fluid deposits formed at or near the edges of the sprayed area. As such, the spraying fluid can be uniformly applied to the surface of the workpiece, with no obvious fringe, therefore greatly improves the coating quality.

In household painting, the general spraying area is relatively small, and the working pressure of the equipment is, for example, about or less than one-third of the pressure of the high-pressure airless spraying machine. The current trend is to use a hand-held electric spray gun for concentrated and efficient small-area spraying. In this case, the sprayed pattern may have uneven diffusion. Because the input pressure of the device is low, more spray fluid is deposited at or near the edge of the spray area, resulting in streaks on the edges of the area. The above defects can usually be reduced or eliminated by increasing the injection pressure to therefore increase the spraying pressure. However, with a high spraying pressure, the fluid particles may easily be dispersed to a larger than intended spraying area. In addition, insufficient adhesion to the coated surface may happen. Therefore, high-pressure airless spraying machines are usually used in industrial coating for large-area construction.

The internal structure of a traditional typical spray tip flow channel includes two parts, a first part being a spraying fluid feed channel and a second part being a spraying fluid atomizing component. The inside of the spraying fluid feed channel is a general circular through hole, which serves to guide the flow of the spraying fluid. The spraying fluid is transmitted to the chamber of the spraying fluid atomizing component, then enters an outlet passage of the spraying fluid atomizing component, and finally passes through a tip outlet orifice with a wedge-shaped cut to produce an atomized spray.

Figure 1:
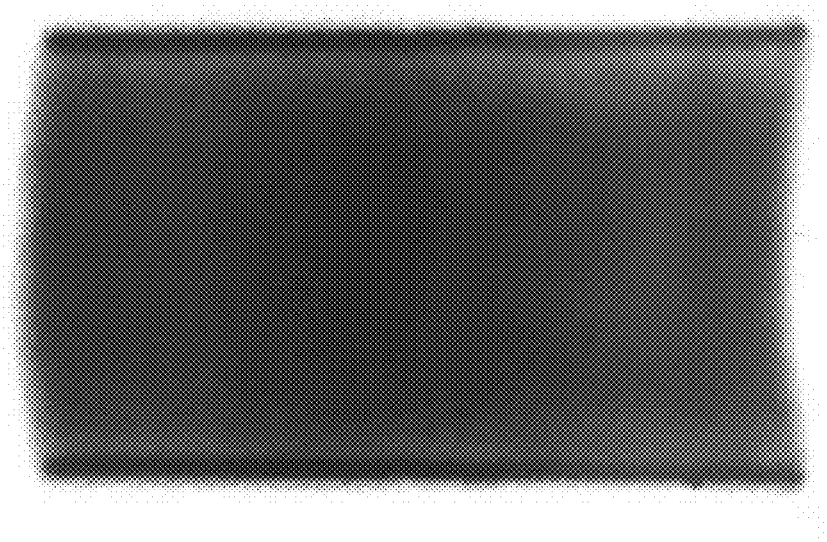
FIG. 1 is a diagram showing a spray pattern using a prior art low pressure spraying equipment.

Since this structure does not produce spray fluid turbulence in the spraying fluid feed channel, the net pressure loss of the spraying fluid at the outlet orifice is significant. In other words, the output pressure at the outlet orifice and the input pressure at the inlet of the spraying fluid feed channel are quite different. The low spraying pressure cannot produce uniform atomization, causing more spray fluid deposited at or near the edge of a spray pattern. This results in streaks on the edges of the pattern, and the distribution of the paint is uneven, as shown in FIG. 1. Therefore, the spraying fluid cannot be uniformly applied to a surface of a workpiece during the spraying operation, and the formation of the obvious streaks directly impacts the coating effectiveness.

The problem of non-uniformity of the spray pattern under low pressure conditions can be solved by changing the internal flow channel structure of the spray tip.

Various embodiments and examples are disclosed in the present disclosure to illustration the solution.

Figure 2:
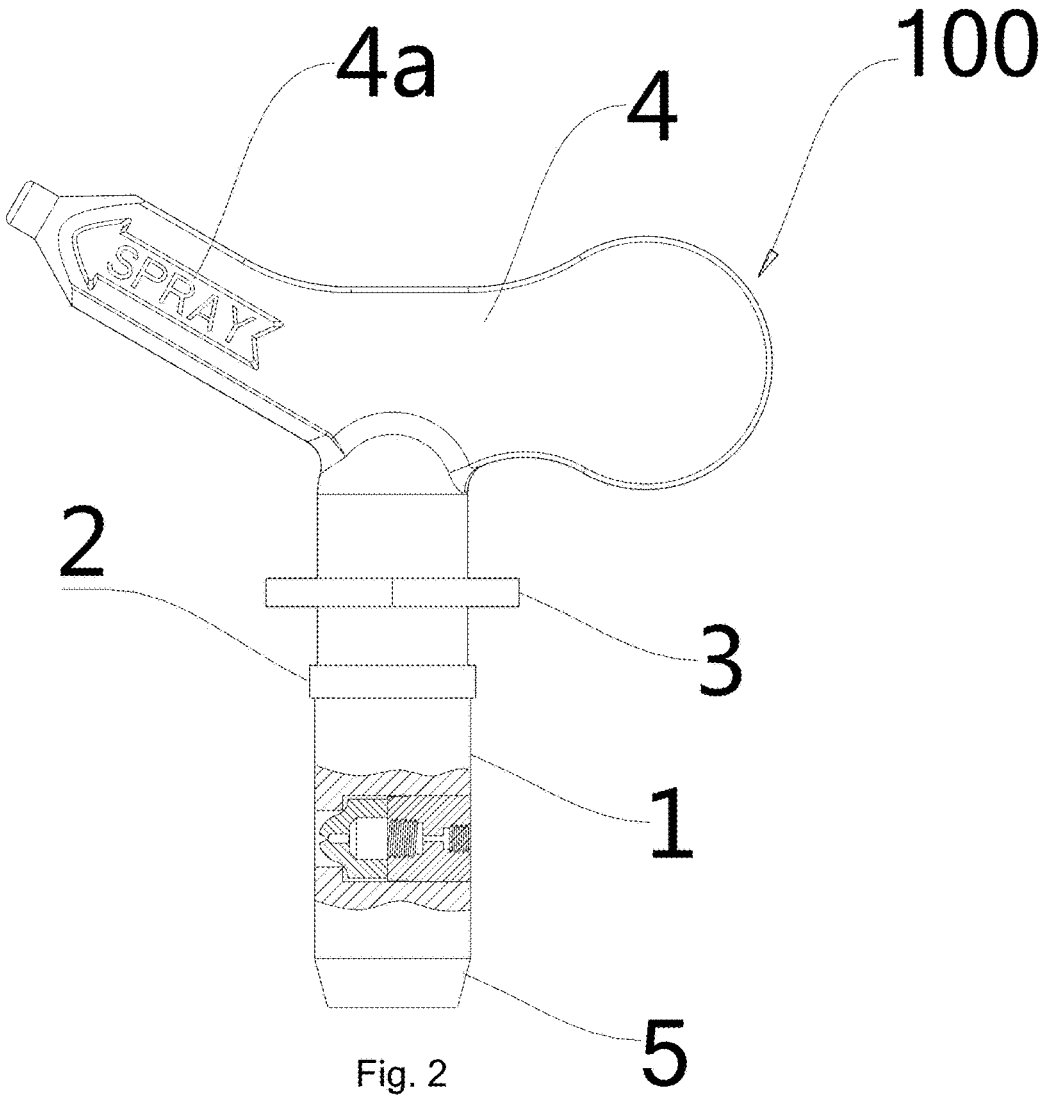
FIG. 2 is a partial cross-sectional view of an example spraying equipment according to the principles of the present disclosure.

As shown in FIG. 2, the example low-pressure spraying equipment 100 includes a spray tip body 1 having a cylindrical structure. The spray tip body 1 includes a chamfer 5 defined at its lower end and a handle 4 arranged on its top. The handle 4 further includes a spray direction indicator 4*a* on its side. The indicator 4*a* is designed to point to a discharge direction of the spray tip body 1. The spray tip body 1 further includes a retaining shoulder 2 and a ring collar 3. The retaining shoulder 2 is disposed above the ring collar 3. The low-pressure spraying equipment 100 can be reversed by rotating the handle 4 for about 180 degrees to be cleansed. The retaining shoulder 2 and the ring collar 3 are arranged to limit the rotation range of the handle 4. As such a fluid feeding entry positioned at the back of the spray body 1 can be turned to the front of the spray tip body 1 to become an outlet orifice. The spray tip body 1 can be made of stainless steel.

Figure 3:
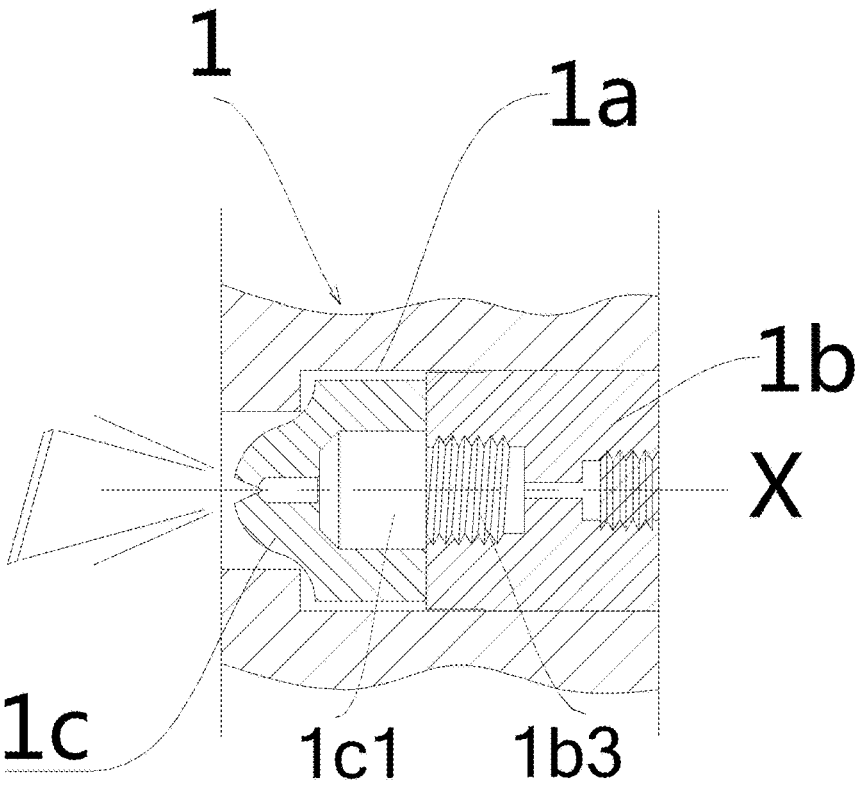
FIG. 3 is an enlarged partial cross-sectional view of the example spraying equipment of FIG. 2.

FIG. 3 is an enlarged partial cross-sectional view of the example spraying equipment 100 showing that the example low-pressure spraying equipment 100 further includes a mounting hole 1*a* opened along a channel axis X, a pre-atomizing component 1*b*, and a tip atomizing component 1*c*. The pre-atomizing component 1*b* and the tip atomizing component 1*c* are connected to each other sequentially along the channel axis X, in a fluid stream direction.

Figure 4:
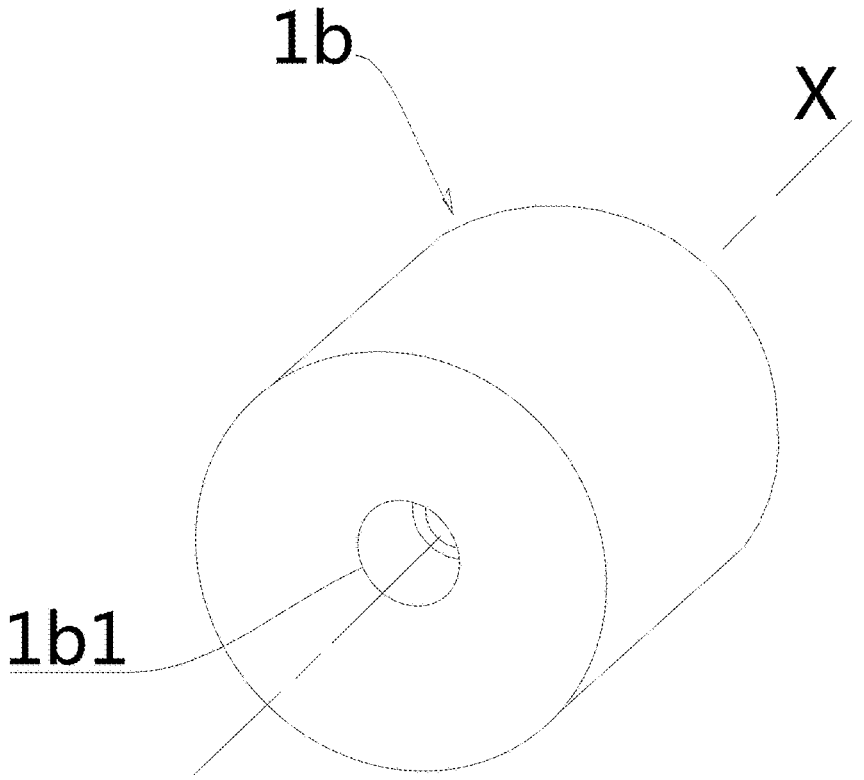
FIG. 4 is a perspective view of a spraying fluid pre-atomizing component of the example spraying equipment of FIG. 2.
Figure 5:
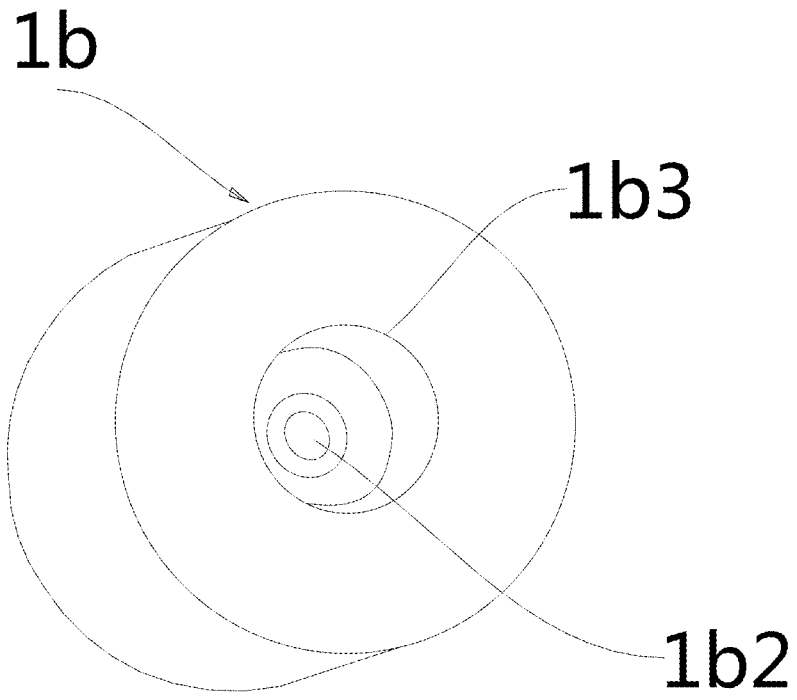
FIG. 5 is another perspective view of the spraying fluid pre-atomizing component of FIG. 4.
Figure 6:
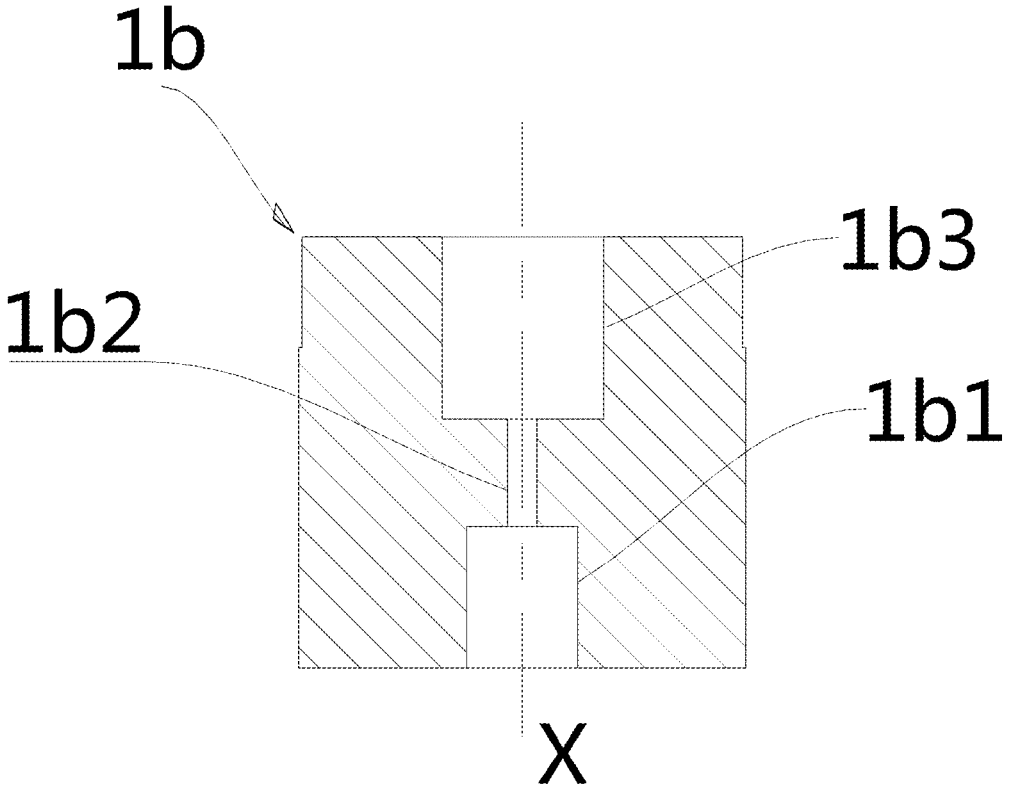
FIG. 6 is a cross-sectional view of the spraying fluid pre-atomizing component of FIG. 4.

In some embodiments, as shown in FIGS. 4-6, a feeding channel 1*b*1, a pre-atomization channel 1*b*2, and a pre-atomization regulating channel 1*b*3 are three coaxial hollow channels sequentially defined and connected along the channel axis X inside the spraying fluid pre-atomizing component 1*b*. The feeding channel 1*b*1, the pre-atomization channel 1*b*2, and the pre-atomization regulating channel 1*b*3 together may form a dumbbell-shaped hallow structure.

Additionally, the feeding channel 1*b*1 and the pre-atomization regulating channel 1*b*3 both have smooth inner surfaces. As shown in FIGS. 4-5, The feeding channel 1*b*1 and the pre-atomization regulating channel 1*b*3 are both cylindrical through holes. As shown in FIG. 6, the pre-atomization channel 1*b*2 is a long narrow cylindrical passage. The diameter of the feeding channel 1*b*1 is smaller than that of the pre-atomization regulating channel 1*b*3. The diameter of the pre-atomization regulating channel 1*b*3 is at least five times as large as that of the pre-atomization channel 1*b*2. The fluid having flown through feeding channel 1*b*1 may be compressed when flowing through pre-atomization channel 1*b*2 and its flowing speed is reduced. When the fluid flows through the pre-atomization regulating channel 1*b*3, its pressure can be released and the fluid achieves pre-atomization. The fluid particles going through the pre-atomizing regulating channel 1*b*3 are violently mixed through the pre-atomization process, forming a turbulent fluid in disordered motions to reduce the net pressure loss of the fluid and refine the fluid particles. As such, the working fluid particles are appropriately refined through the pre-atomization process, which promotes the uniformity of the spray pattern.

Figure 7:
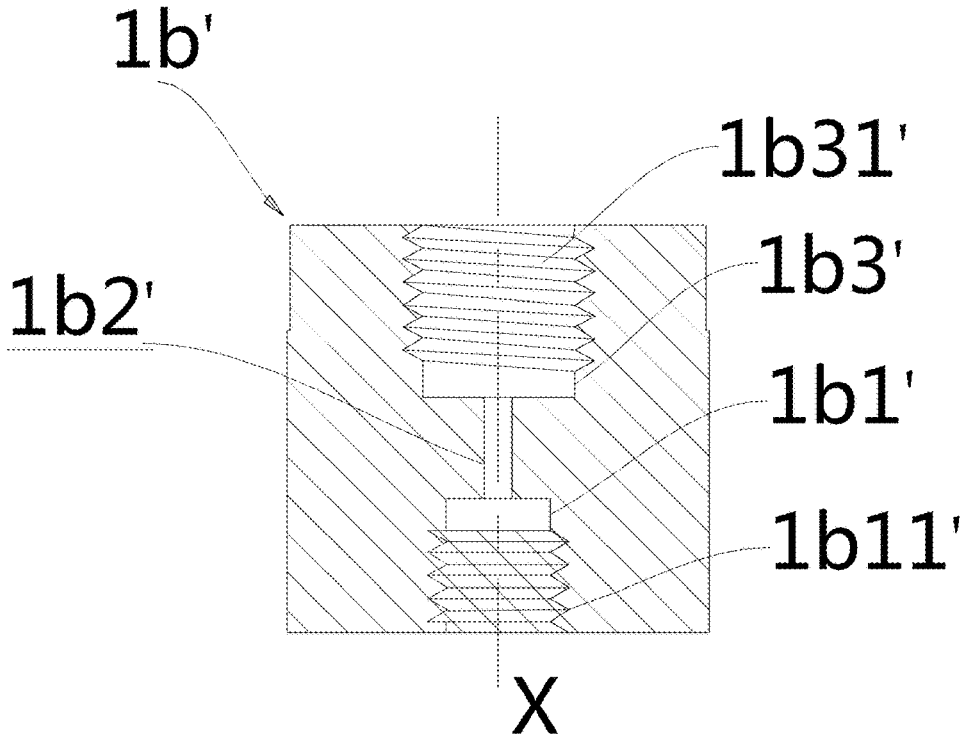
FIG. 7 is another cross-sectional view of the spraying fluid pre-atomizing component of FIG. 4.

Alternatively, in some other embodiments of the pre-atomizing component 1*b*', as shown in FIG. 7, the feeding channel 1*b*1' further includes a feed turbulence thread 1*b*11' on its inner surface, the pre-atomization regulating channel 1*b*3' further includes a regulating turbulence thread 1*b*31' on its inner surface.

The fluid enters the feeding channel 1*b*1' through an upstream feeding entry. The feeding channel 1*b*1' with the feed turbulence thread 1*b*11' on its inner surface may increase the disturbance of the fluid to form a vortex that forces the fluid to rotate towards the upstream along the internal surface of the pre-atomization regulating channel 1*b*3'. As such, the mass flow rate is reduced and the net pressure loss of the fluid is also reduced. Specifically, the fluid is propelled by a swirling force against the internal surface of the internal thread groove of the feed turbulence thread 1*b*11' to thereby reducing the mass flow rate and the net pressure loss of the working fluid.

Additionally, the number of turns of the feed turbulent thread 1*b*11' can be increased or decreased according to the length of the feeding channel 1*b*1', which is a first-stage turbulent chamber for the fluid flowing downstream. Specifically, the number of turns of the feed turbulent thread 1*b*11' may depend on the thread pitch and the relevant specifications that influence the thread turns. For example, smaller number of turns of the feed turbulent thread 1*b*11' may be configured for the feeding channel 1*b*1' having steeper pitch threads but same length. Bigger number of turns of the feed turbulent thread 1*b*11' may be configured for the feeding channel 1*b*1' having same pitch threads but greater length.

Furthermore, the pre-atomized fluid flows through the regulating turbulence thread 1*b*31', which increases the disturbance of the fluid to form a vortex and the fluid is further pushed by the centrifugal force to flow close to the internal surface of the internal thread groove of the regulating turbulence thread 1*b*31'. Accordingly, the mass flow rate is reduced and the net pressure loss of the fluid is therefore further reduced. As such, the net pressure of the fluid from the downstream to the upstream of the pre-atomization channel is balanced.

Similarly, the number of turns of the regulating turbulence thread 1*b*31' can be increased or decreased according to the length of the pre-atomization regulating channel 1*b*3'.

Similar to the components of the pre-atomizing component 1*b*1 of FIG. 6, the diameter of the pre-atomization regulating channel 1*b*3' is at least five times as large as that of the pre-atomization channel 1*b*2'. The pre-atomization regulating channel 1*b*3' is a second-stage turbulent chamber for the fluid to flow towards downstream.

The second-stage turbulent chamber further agitates the vortex in the fluid, to thereby enhancing the turbulence effect and the diffusion of the fluid particles. As such, the net pressure of the working fluid from the downstream to the upstream of the pre-atomization channel 1*b*2' can be balanced. Such strengthened fluid vortex can significantly reduce or eliminate undesirable streaks in the spray pattern shown in FIG. 1. A conventional high-pressure spray tip does not form any vortex in the fluid channel, and may result a large net pressure loss in the spray fluid. In other words, the pressure difference between the output pressure at the outlet and the input pressure at the inlet of the fluid passage is large. Accordingly, the spraying fluid with lower pressure cannot be uniformly applied to the surface of the workpiece during the spraying operation, and the formation of the obvious streaks directly affects the coating quality, as shown in FIG. 1. The present disclosure describes solutions to reduce the net pressure loss by developing the vortex in the fluid channel.

Figure 8:
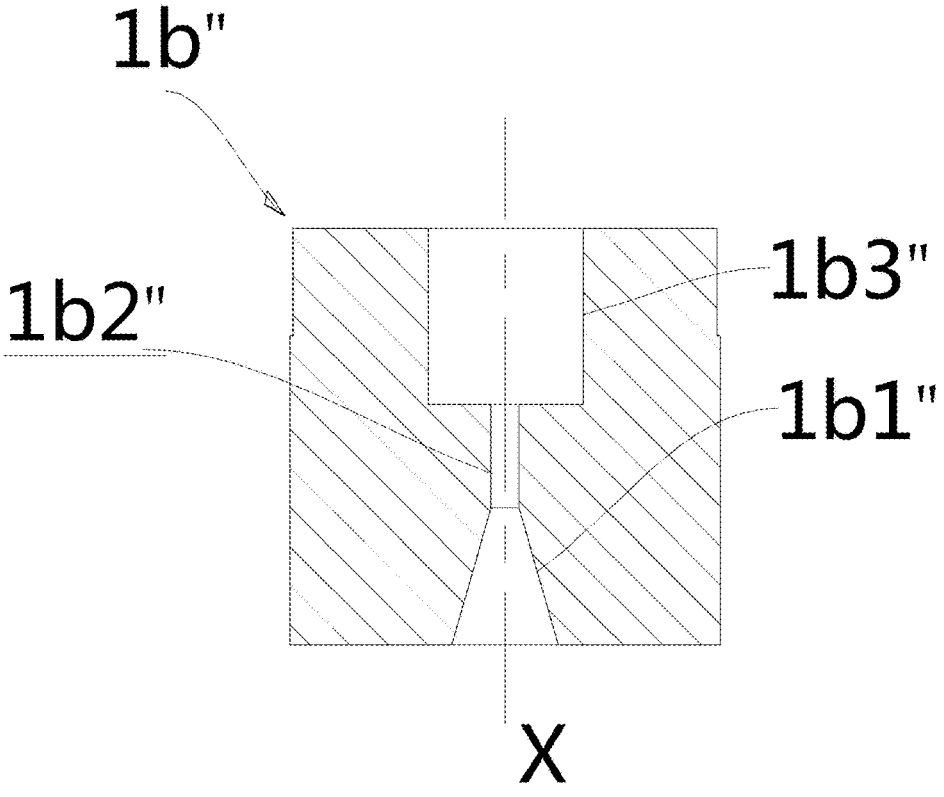
FIG. 8 is yet another cross-sectional view of the spraying fluid pre-atomizing component of FIG. 4.

FIG. 8 shows yet another embodiment of an example pre-atomizing component 1*b*", which includes a feeding channel 1*b*1" having a frustoconical passage narrowing in the feeding direction along the channel axis, a pre-atomization channel 1*b*2", and a pre-atomization regulating channel 1*b*3". The diameter of smaller end of the frustoconical passage of the feeding channel 1*b*1" is substantially the same as that of the pre-atomization channel 1*b*2". The pre-atomization channel 1*b*2" is a long narrow cylindrical passage. The pre-atomization regulating channel 1*b*3" is a cylindrical through hole. The pre-atomizing component 1*b*" has a cylindrical shape, the feeding channel 1*b*1" and the pre-atomization regulating channel 1*b*3" both have smooth inner surfaces.

The frustoconical structured feeding channel 1*b*1" can help the fluid to form vortex inside the channel, and pre-atomize through the pre-atomization channel 1*b*2", thereby reducing the net loss of pressure in the fluid and properly refining the work fluid particles.

Figure 9:
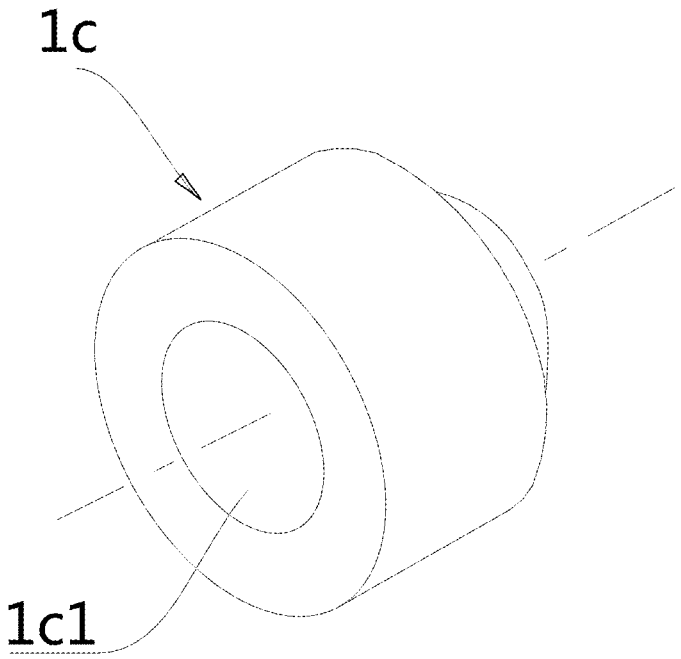
FIG. 9 is a perspective view of a tip atomizing component of the example spraying equipment of FIG. 2.
Figure 10:
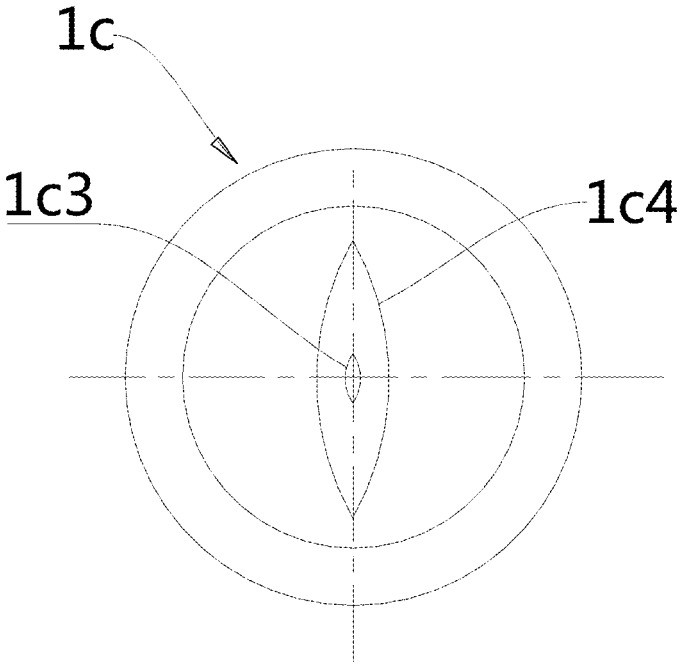
FIG. 10 is a side view of the tip atomizing component of the FIG. 9.
Figure 11:
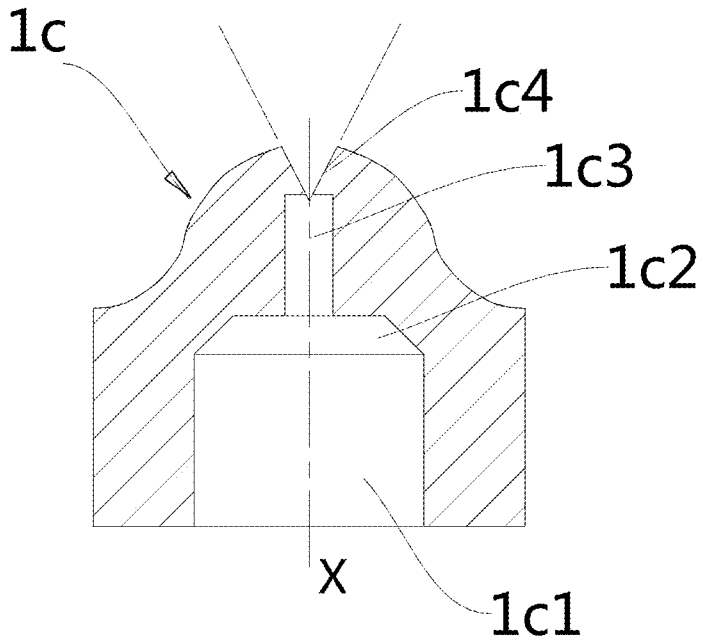
FIG. 11 is a cross-sectional view of the tip atomizing component of the FIG. 9.

As shown in FIGS. 9-11, a turbulence chamber 1*c*1, an outlet passage 1*c*3, and an outlet orifice 1*c*4 are coaxially defined and sequentially connected along the channel axis X inside the tip atomizing component 1*c*. The turbulence chamber 1*c*1 is a cylindrical cavity. A frustoconical passage 1*c*2 is arranged between the turbulence chamber 1*c*1 and the outlet passage 1*c*3. The frustoconical passage 1*c*2 and the turbulence chamber 1*c*1 are coaxial. The outlet passage 1*c*3 is a cylindrical passage that extends from the turbulence chamber 1*c*1 to the outlet orifice 1*c*4.

FIG. 11 shows that the outlet orifice 1*c*4 has a wedge-shaped cut on the tip.

The fluid flows from the pre-atomization regulating channel (e.g., 1*b*3, 1*b*3', or 1*b*3") and enters the turbulence chamber 1*c*1 inside the tip atomizing component 1*c*, in which the fluid expands and increases its flow speed to be kept in a turbulent state.

The fluid further flows from the downstream end to the upstream end of the turbulence chamber 1*c*1 through the frustoconical passage 1*c*2, and is then forced into the outlet passage 1*c*3.

As shown in FIG. 11, the diameter of the outlet passage 1*c*3 is significantly smaller than that of the frustoconical passage 1*c*2. The fluid eventually flows out of the outlet orifice 1*c*4 to produce spray atomization. The outlet orifice 1*c*4 has a wedge-shaped cut that defines the spray pattern.

The tip atomizing component 1*c* is made of tungsten carbide or similar rigid, powder-based materials, and can be grounded or machined to form the outlet orifice 1*c*4. The diameter of the outlet orifice 1*c*4 is the smallest among those of all the orifices or internal passages within the spray tip body 1 of the low-pressure spraying equipment 100. As such, the fluid can be ejected through the outlet orifice 1*c*4 to produce atomization.

FIG. 3 shows that the turbulence chamber 1*c*1 is connected with the pre-atomization regulating channel 1*b*3. The pre-atomizing component 1*b* interference fits the mounting hole 1*a*. The mounting hole 1*a* is a stepped passage, which has a wider section and a narrower section. The pre-atomizing component 1*b* is fitted inside the wider section of the mounting hole 1*a*. An upstream end of the tip atomizing component 1*c* is in a cylindrical shape and is fitted inside the wider section of the mounting hole 1*a*. A downstream end of the tip atomizing component 1*c* includes a spherical shape and is extended into the narrower section of the mounting hole 1*a* by abutting the step surface of the stepped mounting hole 1*a*.

Specifically, the pre-atomizing component (e.g., 1*b*, 1*b*', or 1*b*"), the feeding channel (e.g., 1*b*1, 1*b*1', or 1*b*1"), the pre-atomization channel (e.g., 1*b*2, 1*b*2', or 1*b*2") and the pre-atomization regulating channel (e.g., 1*b*3, 1*b*3', or 1*b*3") are sequentially connected along the channel axis X, in the fluid stream direction. Further, the feeding channel (e.g., 1*b*1, 1*b*1', or 1*b*1"), the pre-atomization channel (e.g., 1*b*2, 1*b*2', or 1*b*2") and the pre-atomization regulating channel (e.g., 1*b*3, 1*b*3', or 1*b*3") as a whole has a dumbbell-shaped structure. The tip atomizing component 1*c* having the turbulence chamber 1*c*1, the outlet passage 1*c*3 and the outlet orifice 1*c*4 are also sequentially connected along the channel axis X, with the turbulence chamber 1*c*1 being connected with the pre-atomization regulating channel (e.g., 1*b*3, 1*b*3', or 1*b*3"), and the outlet orifice 1*c*4 having a wedge-shaped cut outlet.

Further, the downstream end of the tip atomizing component 1*c* includes a spherical shape and abuts the step surface of the stepped mounting hole 1*a*.

A gap space is arranged between the tip atomizing component 1*c* and the mounting hole 1*a* to prevent deposit around the outlet orifice 1*c*4 from impacting the spray pattern.

Figure 12:
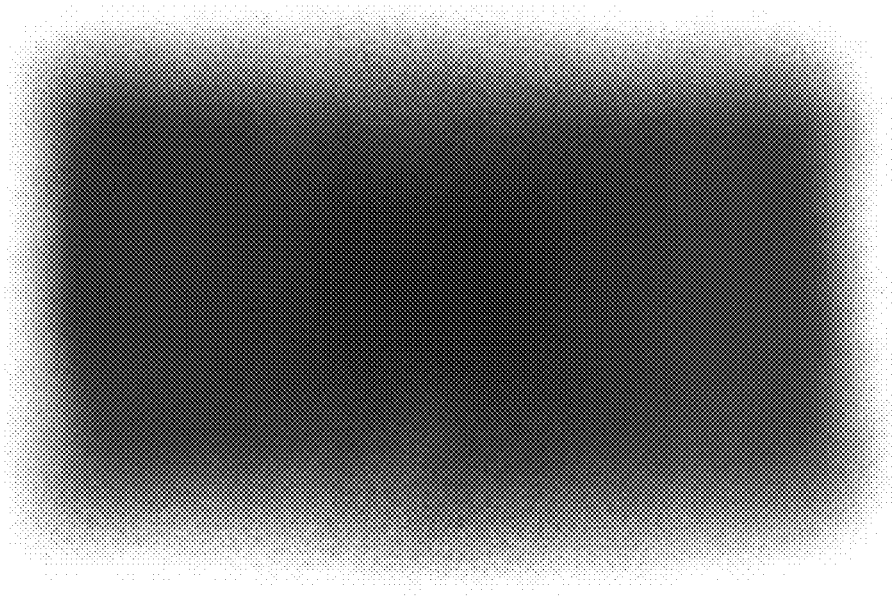
FIG. 12 is a diagram showing a spray pattern using example spraying equipment according to the principles of the present disclosure.

The above low-pressure spray tip design, whether spraying with an electric spray gun or an airless sprayer, with spraying pressure at 1000 psi or lower, can diffuse the spray pattern uniformly during low-pressure spraying. Accordingly, the disclosed example low-pressure spraying equipment can apply the spray fluid uniformly to the surface of the workpiece, eliminate the streaks of spray fluid deposits formed at or near the edges, and greatly improves the coating quality. FIG. 12 shows the improved distribution of the paint with an even coating quality that results from uniformly applied spraying fluid.

In addition, the present low-pressure spray tip design can substantially extend the lifespan of the sprayer. The higher operating pressure usually wears down the spray tip faster. For example, the presented disclosed spray tip can operate well at a pressure of 1000 psi and lower, which is at least 50% lower than the normal operating pressure of a high-pressure airless sprayer in today's market, such as 2000 psi to 3000 psi. As such, the spray tip according to the present disclosure can increase the working lifespan by at least 50%, can meanwhile resolve the issue of overspraying.

In summary, the present disclosure provides the following advantages:

Firstly, whether spraying with an electric spray gun or an airless sprayer, the low-pressure spraying equipment can diffuse the spray pattern uniformly during low-pressure spraying, thereby applying the spray fluid uniformly to the surface of the workpiece and eliminating the streaks of spray fluid deposits formed at or near the edges, which greatly improves the coating quality.

Secondly, the use of low-pressure spraying equipment can also significantly extend the lifespan of the sprayer. The higher the pressure, the greater the friction, and the lower the service life, and vice versa. For example, when the high-pressure airless sprayer uses the current invention low-pressure spray tip, the working pressure can be reduced by at least one-half compared to the use of conventional high-pressure spray tips, therefore, the service life of the sprayer can be almost doubled. It also solves the problem of over-spray of the spray fluid.

Thirdly, the spray pattern of the low-pressure spray tip of the current invention has the characteristics of high density in the middle and uniform dilution on both edges. As such, during continuous spraying, two adjacent thin edges are overlapped to form substantially the same density as the middle portion, which greatly reduces the difficulty of splicing adjacent painting areas, and therefore improves the aesthetics of the coating.

Lastly, the current invention realizes a secondary atomization by improving the internal flow channels, so that the particles of the sprayed fluid after atomization are further refined than the conventional high-pressure spray tip, which further improves the aesthetics of the coating.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules, elements, components, layers, etc.) are described using various terms, including "connected," "engaged," "coupled," "adjacent," "next to," "on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements.

As used herein, the phrase at least one of A, B, and C should be construed to mean a logical (A OR B OR C), using a non-exclusive logical OR, and should not be construed to mean "at least one of A, at least one of B, and at least one of C." The term subset does not necessarily require a proper subset. In other words, a first subset of a first set may be coextensive with (equal to) the first set.

What is claimed is:

1. A low-pressure spraying equipment for atomizing a working fluid at a low-pressure, the low-pressure spraying equipment comprising:

a spray tip body having a top and a lower end;

a handle arranged on the top of the spray tip body; and a chamfer defined at the lower end of the spray tip body, wherein:

the low-pressure is at 1000 psi or lower, the low-pressure spraying equipment is configured to uniformly apply the working fluid with the low-pressure to a surface of a workpiece during a spraying operation, the handle further comprises a spray direction indicator on a side of the handle, the spray direction indicator is designed to point to a discharge direction of the spray tip body, the spray tip body further comprises a retaining shoulder and a ring collar, a mounting hole having a channel axis, a pre-atomizing component, and a tip atomizing component, the pre-atomizing component further comprises a feeding channel, a pre-atomization channel, and a pre-atomization regulating channel, the feeding channel, the pre-atomization channel, and the pre-atomization regulating channel are three coaxial hollow channels sequentially defined and connected along the channel axis inside the pre-atomizing component, the feeding channel, the pre-atomization channel, and the pre-atomization regulating channel form a dumb-bell-shaped hallow structure, the pre-atomization regulating channel having a uniform diameter that is at least five times as large as a uniform diameter of the pre-atomization channel to compress the working fluid when the working fluid is flowing through the pre-atomization channel, the feeding channel is a single cylindrical through hole with an inner surface having a feed turbulence thread to force the working fluid to rotate along the internal surface of the feeding channel and towards the pre-atomization channel to compress the working fluid and reduce a flowing speed of the working fluid and then sequentially flow through the pre-atomization regulating channel with an inner surface having a regulating turbulence thread to further mix the working fluid to form a turbulent fluid in disordered motions and release the low-pressure of the working fluid, the pre-atomization regulating channel is a single cylindrical through hole with the inner surface having the regulating turbulence thread to form a vortex and push the working fluid to flow to the internal surface of the regulating turbulence thread to thereby reduce a net pressure loss of the working fluid and refine particles of the working fluid to promote a uniform spray pattern, and the pre-atomizing component and the tip atomizing component are connected to each other sequentially along the channel axis, in a fluid stream direction.

2. The low-pressure spraying equipment of claim 1, wherein the retaining shoulder is disposed below the ring collar, and the low-pressure spraying equipment is operated to be reversible by rotating the handle for 180 degrees when the low-pressure spraying equipment is cleansed.

3. The low-pressure spraying equipment of claim 2, wherein the retaining shoulder and the ring collar are arranged to limit the rotation range of the handle.

4. The low-pressure spraying equipment of claim 1, wherein the spray tip body is made of stainless steel.

5. The low-pressure spraying equipment of claim 1, wherein the feeding channel and the pre-atomization regulating channel are both cylindrical through holes having smooth inner surfaces, and the pre-atomization channel is an elongated cylindrical passage.

6. The low-pressure spraying equipment of claim 5, wherein a diameter of the feeding channel is smaller than a diameter of the pre-atomization regulating channel.

7. The low-pressure spraying equipment of claim 1, wherein the tip atomizing component further comprises a turbulence chamber, a frustoconical passage, an outlet passage, and an outlet orifice, the turbulence chamber, the frustoconical passage, the outlet passage, and the outlet orifice are coaxially defined and sequentially connected along the channel axis inside the tip atomizing component.

8. The low-pressure spraying equipment of claim 7, wherein the turbulence chamber is a cylindrical cavity.

9. The low-pressure spraying equipment of claim 8, wherein the frustoconical passage is arranged between the turbulence chamber and the outlet passage.

10. The low-pressure spraying equipment of claim 9, wherein the outlet passage is a cylindrical passage that extends from the frustoconical passage to the outlet orifice.

11. The low-pressure spraying equipment of claim 10, wherein the outlet orifice includes a wedge-shaped cut outlet.

12. The low-pressure spraying equipment of claim 7, wherein the turbulence chamber is connected with the pre-atomization regulating channel.

13. The low-pressure spraying equipment of claim 12, wherein the mounting hole is a stepped passage having a wider section and a narrower section, the pre-atomizing component is adapted to fit inside the wider section of the mounting hole, an upstream end of the tip atomizing component having a cylindrical shape is adapted to fit inside the wider section of the mounting hole, and a downstream end of the tip atomizing component having a spherical shape is adapted to extend into the narrower section of the mounting hole by abutting a step surface of the stepped passage.

* * * * *